United States Patent [19]

Lacotte et al.

[11] Patent Number: 4,985,951

[45] Date of Patent: Jan. 22, 1991

[54] FLEXIBLE MATTRESS INCLUDING VEGETABLE FIBERS

[76] Inventors: Phillipe G. V. Lacotte, 3, rue Montéra, 75012 Paris; Norbert Smil, La Grande Bastide - La Rouvière, 83520 Roquebrune-sur-Argens, both of France

[21] Appl. No.: 463,517

[22] Filed: Jan. 11, 1990

[30] Foreign Application Priority Data

Jan. 11, 1989 [FR] France ..... 89 00285

[51] Int. Cl.[5] ..... A47C 27/22

[52] U.S. Cl. ..... 5/465; 5/448; 5/481

[58] Field of Search ..... 5/465, 448, 464, 481

[56] References Cited

U.S. PATENT DOCUMENTS 3,210,781 10/1965 Pollock ..... 5/464
3,521,311 7/1970 Cohen ..... 5/465

FOREIGN PATENT DOCUMENTS 552612 11/1956 Belgium .
2827821 1/1980 Fed. Rep. of Germany ..... 5/475
2187113 9/1987 United Kingdom .

*Primary Examiner*—Alexander Grosz
*Attorney, Agent, or Firm*—Wenderoth, Lind & Ponack

[57] ABSTRACT

A matress has a layer of a material formed of or including vegetable fibers which may be covered on one or both faces with a layer of foam material which is capable of undergoing a localized deformation along a fold line while retaining the continuity of its surface. The layer of material including vegetable fibers is constituted by at least two blocks having a junction zone which is located roughly in a transverse plane and along a fold line. A layer of foam material is provided in the vicinity of the junction zone on each side of a transverse plane, this layer of foam material being fixed to each of the upper and lower faces of the layer of material including vegetable fibers.

13 Claims, 1 Drawing Sheet

FLEXIBLE MATTRESS INCLUDING VEGETABLE FIBERS

BACKGROUND OF THE INVENTION

The present invention relates to mattresses and more particularly to mattresses including vegetable fibers.

Mattresses formed of or including vegetable fibers, such as coconut fibers, are known which have high qualities of comfort. They are in the form of a layer of coconut fibers agglomerated by microparticles of latex which impart a certain flexibility to the mattress.

The mattresses may be covered with a layer of latex on one of their two faces.

Mattresses of coconut fibers are also known which are converted on their upper face with a layer of latex and, in order to improve comfort, are composed of a plurality of parts of coconut fibers of different densities (density of 60 kg/cu.m at the head and foot ends, and 80 kg/cu.m in the region of the back). The part of different densities are separate and interconnected by transverse layers composed of latex.

A drawback of these different types of mattress resides in the fact that, when they are placed on deformable bolsters having for example raisable head and foot ends, there is a risk of a rupture of the vegetable fibers owing to the low flexibility of these mattresses.

Another drawback resides in the fact that, when the layer of vegetable fibers is covered with a layer of foam material, the latter has a tendency to form rolls and hollows at the fold lines of the bolster.

In the case if the aforementioned mattresses formed by blocks of different densities interconnected by a layer of latex, if the fold or bend line is located in the region of the transverse layer of latex, there is a risk of separation of the coconut fibers from this transverse layer of latex, whereas, moreover, the part where the upper layer of latex has a tendency to form a roll on the surface of the mattress.

SUMMARY OF THE INVENTION

An object of the invention is to provide a mattress formed of or including fibers which is capable of undergoing a localized deformation along a fold line while retaining the continuity of the surface of the mattress.

The invention therefore provides a mattress comprising at least one layer of material formed of or comprising fibers which is constituted by at least two blocks having a junction zone located roughly in a transverse plane, wherein the junction zone between said blocks is disposed along a mattress fold line and a layer of foam material is provided at least in the vicinity of the junction zone on each side of said transverse plane and fixed to each of the upper and lower faces of the layer of material comprising vegetable fibers.

According to other features of the invention:

The blocks of material including vegetable fibers are in adjoining or substantially adjoining relation to each other so that end portions thereof located on each side of the junction zone are free to move away from each other by forming a dihedron about an axis corresponding substantially to the fold line, thereby avoiding any risk of rupture of the vegetable fibers. The expression adjoining or substantially adjoining relation is intended to mean that in any case there is no foam material adhered to confronting vertical surface of the blocks including vegetable fibers.

The foam material provided in the region of the junction zone on each side of a transverse plane is fixed to the layer of coconut fibers along connection surfaces oriented parallel to the surface of the mattress.

In the vicinity of the junction zone, the thickness of each of the blocks of material including vegetable fibers is less than one half of the total thickness of the mattress.

In the vicinity of said junction zone, the blocks of material including vegetable fibers comprise a band of reduced thickness.

A preferred foam material for the realization of the mattresses according to the invention is a natural latex foam material and the vegetable fibers is preferably coconut fiber agglomerated by microparticles of natural latex.

Advantageously, the density of the foam material is substantially the same as the density of the layer of material including vegetable fibers.

BRIEF DESCRIPTION OF THE DRAWINGS

The invention is described hereinafter in more detail with reference to the accompanying drawings, in which.

DETAILED DESCRIPTION OF THE INVENTION

Figure 1:
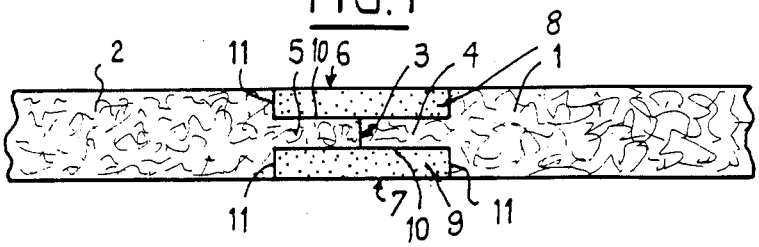
FIG. 1 is a partial longitudinal sectional view of a mattress according to a first embodiment of the invention.

In the first embodiment of the invention illustrated in FIG. 1, the mattresses comprises at least two block 1, 2 of material formed of or including fibers arranged in end-to-end relation in the longitudinal direction of the mattress. The junction zone, located in a transverse plane with respect to this longitudinal direction, is designated by the reference character 3. Each block comprises in the region of the junction zone an end portion 4, 5 of reduced thickness located in the median part of each of the blocks. The latter define in this way a recess 6, 7 on each side of the junction zone and on the upper and lower faces of the mattress. Each recess is filled with a band or layer 8, 9 of a foam material fixed for example by adhesion so said end portions. This adhesion is effected preferably on the horizontal surface 10 and vertical surface 11 delimiting the recesses 6, 8. The width of the recess is advantageously 25 cm.

Figure 2:
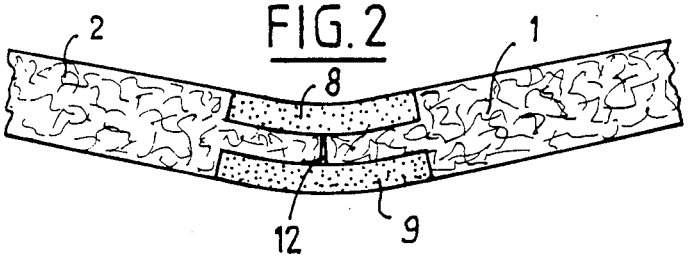
FIG. 2 is a longitudinal section view of the same mattress in a folded position.

When the mattress is in the folded position as shown in FIG. 2, the end portions 4, 5 of the blocks of vegetable fiber material separate from each other and form a dihedron 12. The bands of foam material 8, 9 located above and below the junction zone are deformed and stretched owing to the elastic properties of the latex. It is found that in this way, when the mattress is bent, the forces are applied mainly tangentially to the surface of connection of the layer of foam material with the layer of vegetable fibers and do not produce a tearing-apart effect.

In a second embodiment of the invention, the mattress comprises a layer of foam material 8 fixed to the whole of the face of the layer of material including vegetable fibers. Owing to the presence of this layer of foam material 8, a single recess 7 is all that is necessary. The recess 7 having a width on the order of 25 cm is located on the face of the layer of material including vegetable fibers which is not covered with foam material 8 and is filled with a layer or band of foam material 9 fixed to the end portions 4 and 5.

In the third embodiment of the invention, the mattress comprises, fixed on each face of the layer of material including vegetable fibers, a layer of foam material 8 and 9. With this structure in three layers, it is unnecessary to provide a recess.

For the same reason, the thickness of the end portions 4 and 5 of the blocks 1 and 2 located on each side of the junction zone 3, is not reduced, the thickness of the layer of material including vegetable fibers being substantially the same throughout the length of the mattress.

It is advantageous to arrange that the thickness of the blocks of material including vegetable fibers be on the order of one third of the total thickness of the mattress, which permits easily producing from the technical and economical points of view the mattress according to the invention by the assembly and adhesion of blocks having substantially the same thickness.

For example, in the case of a mattress of coconut fibers according to the first embodiment of the invention, blocks of material including coconut fibers are assembled so as to form three superimposed layers, the blocks of material including coconut fibers of the central layer being offset relative to the other two blocks of material including coconut fibers so as to form a junction and recesses such as described hereinbefore in the region of the desired place of the fold line.

Figure 3:
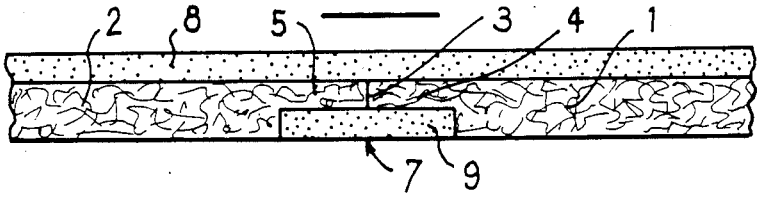
FIG. 3 is a longitudinal sectional view of a mattress according to the second embodiment of the invention.
Figure 4:
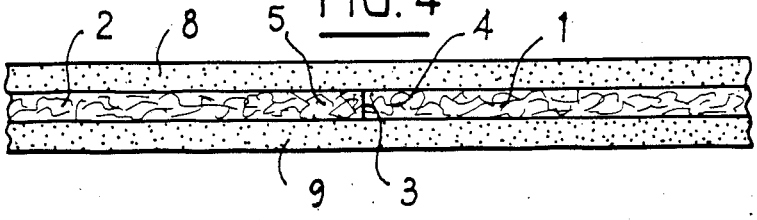
FIG. 4 is a longitudinal sectional view of a mattress according to a third embodiment of the invention.

Likewise, in the case of the embodiment shown in FIG. 3, blocks of materials including coconut fibers are assembled in such manner as to form two superimposed layers in such a way that the blocks of material including coconut fibers of the upper layer form a junction at the desired place of the fold line.

The mattresses according to the invention may be mattresses for beds, reclining chairs, convertible settees or sofas, etc. They may be in any generally available sizes and covered with the conventionally-employed covers.

The present invention avoids the drawbacks of the prior art in that the mattresses it provides result in neither rupture of the layer of material including vegetable fibers nor discontinuity of the surface when bent. They are easy to make technically and inexpensive to manufacture.

We claim:

1. Mattress comprising:

at least one layer of material comprising vegetable fibers and which has an upper face and a lower face and is constituted by at least two blocks being in substantially adjacent relation and defining a junction zone between said blocks located substantially in a transverse plane of the mattress, said junction zone between said blocks being disposed along a fold line of the mattress, and layers of foam material disposed at least in the vicinity of said junction zone on each side of said transverse plane, respective said layers of foam material being fixed to said face and said lower face of said layer of material.

2. Mattress according to claim 1, wherein said blocks are in direct adjoining relation to each other in said junction zone.

3. Mattress according to claim 1, wherein said blocks have end portions having confronting surfaces which are free to move away from each other in said junction zone.

4. Mattress according to claim 1, wherein the thickness of each of said blocks is less than one half of the total thickness of the mattress at least in the vicinity of said junction zone between said blocks.

5. Mattress according to claim 1, wherein each block has an end portion of reduced thickness in the region of said junction zone, said end portions of reduced thickness being located in confronting relation to each other, the adjacent blocks thereby defining at least one recess, a layer of foam material filling said at least one recess and being fixed to said end portions.

6. Mattress according to claim 5, wherein said end portions of reduced thickness located in confronting relation to each other in the region of said junction zone define recesses on each side of said junction zone and on said upper face and said lower face of said layer of material comprising vegetable fibers, and a said layer of foam material fills each said recess and is fixed to said end portions.

7. Mattress according to claim 6, wherein said vegetable fibers are coconut fibers.

8. Mattress according to claim 6, wherein the reduced thickness of said end portions located in confronting relation to each other in the region of said junction zone is on the order of one third of the total thickness of the mattress.

9. Mattress according to claim 5, comprising a said layer of foam material fixed to the whole of one of said faces of said layer of material comprising vegetable fibers and a single said recess located on the other of said faces of said layer of material comprising vegetable fibers.

10. Mattress according to claim 9, wherein the reduced thickness of said end portions located in confronting relation to each other in the region of said junction zone is on the order of one third of the total thickness of the mattress.

11. Mattress according to claim 1, comprising a said layer of foam material fixed to each of said faces of said layer of material comprising vegetable fibers, the layer of vegetable fibers having a thickness which is substantially constant throughout the length of the mattress.

12. Mattress according to claim 1, wherein said foam material is a foam of natural latex, said vegetable fibers are coconut fibers, and microparticles of natural latex interconnect and coconut fibers.

13. Mattress according to claim 1, wherein said foam material and said layer of material comprising vegetable fibers have densities that are substantially the same.

* * * * *